US010497324B2

(12) United States Patent
Heilbron

(10) Patent No.: US 10,497,324 B2
(45) Date of Patent: Dec. 3, 2019

(54) EYE ANIMATION DEVICE AND METHOD TO SHOW EYE EXPRESSION IN 2D AND 3D LIGHTED DISPLAYS

(71) Applicant: Valerie J. Heilbron, Shelton, CT (US)

(72) Inventor: Valerie J. Heilbron, Shelton, CT (US)

( * ) Notice: Subject to any disclaimer, the term of this patent is extended or adjusted under 35 U.S.C. 154(b) by 0 days.

(21) Appl. No.: 16/362,815

(22) Filed: Mar. 25, 2019

(65) Prior Publication Data

US 2019/0221166 A1 Jul. 18, 2019

Related U.S. Application Data

(63) Continuation of application No. 15/466,003, filed on Mar. 22, 2017, now Pat. No. 10,360,859.

(51) Int. Cl.
*A63H 3/00* (2006.01)
*G09G 3/34* (2006.01)
(Continued)

(52) U.S. Cl.
CPC ..... *G09G 3/342* (2013.01); *A63H 3/006* (2013.01); *A63H 3/365* (2013.01); *A63H 3/38* (2013.01);
(Continued)

(58) Field of Classification Search
CPC ..... A63H 3/38; A63H 3/42; A63H 3/365
See application file for complete search history.

(56) References Cited

U.S. PATENT DOCUMENTS 6,055,032 A * 4/2000 Osterhout ..... A63H 3/365 349/142
6,576,013 B1 * 6/2003 Budman ..... A61F 2/141 446/392
(Continued)

FOREIGN PATENT DOCUMENTS

GB 2057277 A * 4/1981 ..... A63H 3/006

OTHER PUBLICATIONS

Spin Master Ltd, Zoomer product description, 2013-2016.

*Primary Examiner* — Charlie Y Peng

(57) ABSTRACT

An illuminated display device with a base member representing an eye and having a primary cavity therein, usually existing as a pair of devices to represent two eyes. Thin walls within the primary cavity divide it into multiple chambers, wherein each chamber has a unique shape and volume that represents a view of a unique emotive response in an eye. Illumination devices are placed in each unique thin-walled chamber shape to emit light in a pattern from the chamber volume through a top opening of the cavity. Lighting all illumination devices equally imitates an open eye, while illuminating the volume of one or more unique chamber shapes at OFF or lesser brightness than the volume in other chambers creates a negative space, giving the illusion that the eye has changed shape to equal the shape in the brightly lit chambers only. The device can thus imitate the changing shapes in an eye shown when expressing emotion and the device is capable of exhibiting eight or more distinct emotive responses. A speaker can emit sounds in synchronization with a pattern of illumination to enhance the emotive effect. The unique chamber shapes and volumes in the primary cavity can be covered by translucent material that may be printed with a graphic representation of an eye.

12 Claims, 10 Drawing Sheets

(51) Int. Cl.

| | |
|---|---|
| ***A63H 3/38*** | (2006.01) |
| ***G09G 3/32*** | (2016.01) |
| ***A63H 3/36*** | (2006.01) |
| ***A63H 3/42*** | (2006.01) |

(52) U.S. Cl.
CPC ..... *A63H 3/42* (2013.01); *G09G 3/32* (2013.01); *G09G 2320/064* (2013.01)

(56) References Cited

U.S. PATENT DOCUMENTS

| | | | | |
|---|---|---|---|---|
| 6,786,794 | B2 * | 9/2004 | Bae | A63H 3/38 446/389 |
| 2004/0087246 | A1 * | 5/2004 | Chase | A63H 3/38 446/392 |
| 2010/0120328 | A1 * | 5/2010 | Su | A63H 3/40 446/389 |
| 2010/0136880 | A1 * | 6/2010 | Liu | A63H 3/38 446/392 |

* cited by examiner

EYE ANIMATION DEVICE AND METHOD TO SHOW EYE EXPRESSION IN 2D AND 3D LIGHTED DISPLAYS

RELATED APPLICATION

This application is a continuation of U.S. application Ser. No. 15/466,003 filed Mar. 22, 2017. The disclosure of the above application is incorporated herein by reference.

FIELD OF THE INVENTION

The present invention relates generally to illuminated and visual display devices. More specifically, disclosed and protected herein are lighted display devices capable of representing an eye and imitating an eye's emotive expressions, particularly in an animated sequence.

BACKGROUND OF THE INVENTION

Children often see character toys as companions. It has long been a goal of inventors to make character toy faces changeable and expressive so they more closely resemble a live companion. Toy makers take much care in the graphic representation of character faces, and both mechanical and electronic features have been added to render toy faces changeable. In U.S. Pat. No. 9,474,981, Forti displays a plush face with eyebrows placed at the outer eye to depict a nice expression. The eyebrows can then be moved to a second position on the inside of the eye to depict an angry expression. In U.S. Pat. No. 5,000,714, Su constructs an eye device where LEDs are positioned behind a screen and the screen is positioned behind a dimensional lens. The screen is printed with an image of the pupil and iris of an eye. By alternating the illumination of the LEDs, the pupil and iris appear to move around the lens. Where Forti achieves believable depictions of two emotions, he relies both on a particular eye configuration with eyebrows and on intentional action to display those emotions, and he is limited to two expressions. Su achieves programmed eye movement that can be varied and interesting, but those eye movements do not conjure distinct emotive states for a character.

To date, available technology for mechanical solutions to the problem of creating expressive eyes offers fewer and less natural-looking options than electronic solutions to the problem, so they are not considered within the purview of the present invention. In contrast, an electronic solution as found in U.S. Pat. No. 8,651,916, by Irmler et al. is quite sophisticated in realistically moving the image of an eye around. However, eyes normally change shape when they express different emotions and achieving the illusion of that changed-shape condition is critically important in any device that sets out to replicate an emotive state in a face. For example, wide, rounded eyes show the expression of shock or surprise and narrowing the eyes to horizontal slits indicates intensity or suspicion. Irmler's construct cannot portray such an eye shape-changing condition. In addition, Su and Irmler use technology that is complicated and costly and therefore not appropriate for use in a toy.

In U.S. Pat. No. 8,647,167, the inventor of the present invention created an electronic display useful in representing eyes and a mouth to create an animated talking character. The inventor provided for eye illumination and a simple, on-off illumination method to approximate a blink. As with other eye animations mentioned herein, this method achieved the illusion of the character being alive to a certain degree, but it did not create any representation of distinct emotive states.

Liquid crystal displays (LCDs) have recently come down in price and are now being used to great advantage in doll eyes, where they create a wide range of believable expressions representative of emotional states. However, LCD eye technology has the disadvantages of being completely flat, looking similar from one application to another, and definitely putting a character toy using the technology into the upper price range for similar toys.

The need remains for expressive character eyes in mid-to-lower priced toys.

SUMMARY OF THE INVENTION

A basic goal of the present invention is to provide a device and method that produce an illusion of character toy eyes changing expression. This device preferably will also have a low manufacturing cost, a simple construction, and be useable for a variety of character eye shapes and sizes.

These and further objects and advantages of the present invention will become obvious not only to one who reviews the present specification and drawings but also to those who have an opportunity to experience an embodiment of the lighted display device disclosed herein in operation. It will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

As previously mentioned, we first recognize a changed expression in an eye by the change in the eye's shape, and the construct of this display device offers differing shapes for eye illumination. The base member of the device is made of molded resin, shaped like the "open" outline of the eye to be animated, and the base member has a primary cavity of a varying depth. Two base members are used to animate two eyes, one base member per eye.

The necessary depth may be dependent on the illumination volume of the cavity in the base member. For example, an 18-inch character toy may have a cavity depth of 0.5 inch. The base member may be slightly contoured if needed to fit a rounded character face, but most often flat base members will fit the eye area well.

Thin walls may divide the cavity into a number of chambers according to the desired expressions for the particular character being animated. The relationship between the cavity's thin walls and the resultant eye expressions is discussed further below. Each chamber houses at least one illuminating device, such as a Surface Mount Diode, that can be connected to a two-sided printed circuit board seated to the bottom of the base member, such as where that base member has been molded with no bottom wall. Alternatively, holes for light sources, such as LEDs, can be molded into the bottom wall of the base member. The cavity and thin walls are opaque, so light from each chamber emits only from the cavity top at that chamber and not through the walls. The inside of the cavity and the thin walls may be enhanced with reflective material.

The cavity can produce, for instance, three or more unique expressions in addition to the distinct expressions of Open and Blinking/winking, depending, for example, on which expressions are selected and how much room those expressions need in the thin-walled chamber division of the primary cavity. Light from an illuminating device emits out the top of the cavity in the shape of the chamber formed by the thin walls and cavity sides surrounding the illumination device. The top of the cavity can be covered with a translucent covering.

The resultant lit shape from the chamber(s) will tend to be uniform in its illumination. Should hotspots appear within an illuminated shape, the depth of the cavity can be increased. Additionally or alternatively, a diffusing layer of fabric or plastic can be placed on the top of the cavity, such as over the translucent covering. A diffusing layer may also be necessary to obscure the tops of the thin walls and keep the lines from those wall tops from interrupting the eye representation. Depending on the realism of the facial effect desired, the graphic representation of an eye printed on the translucent fabric or plastic of the toy can be placed over the final top layer of the cavity in exact registration with the chambers in the illumination device. No claim is made to the condition where the graphic eye representation is printed on the inside of the toy's fabric or plastic layer so that it only shows when the base member is illuminated. In that situation, claim is only made to the animated expressions on that backlit graphic representation of an eye. Eliminating this graphic eye representation entirely results in a more abstract facial effect. A glass or plastic eyepiece can alternatively take the place of an eye graphic.

Means, such as a processor in combination with a power source, are provided to illuminate the illumination devices in a pattern that mimics the look of eyes during a conversation. The pattern of illumination can be as follows: when all LEDs in the cavity are on, the eye has the illusion of being open; when one or more chambers are unlit or shown at a lesser brightness than other LEDs, a negative space is created within the area of the whole eye, so the perceived shape of the eye changes from the outline of the cavity to the outline of all lit chambers, and this change in eye shape gives an expression viewed as an emotive reaction from the character. Special programming for the light sources approximates two distinct blinking effects that add to the "alive" effect of the eye animation. The programming details for light transitioning between chambers and for what can be referred to as Blink 1 and Blink 2 will be revealed in the detailed description following. A speaker can be employed to synchronize a conversation, song, or sounds to the illumination pattern and thereby reinforce the eye expressions when the eye animations move in synch to the emotive content of the sounds.

The disclosed device can be manufactured efficiently and at a relatively low cost. The components employed contribute to the foregoing in that the materials employed comprise two small molded resin base members, three to twelve LEDs, a microprocessor, a printed circuit board (PCB), an integrated circuit (IC), electronic wires, and a switch. Batteries and one or more speakers are usually present in character toys, and the present invention can piggyback onto those existing components.

It will be understood that the base member can be molded into any desired shape or size and to fit the eyes on any character's face.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

In the accompanying drawings:

FIG. 1B is a view in the front elevation of a lighted display device according to the present invention in the form of a doll in the animated condition of all light sources ON;

DETAILED DESCRIPTION OF PREFERRED EMBODIMENTS

Figure 1A:
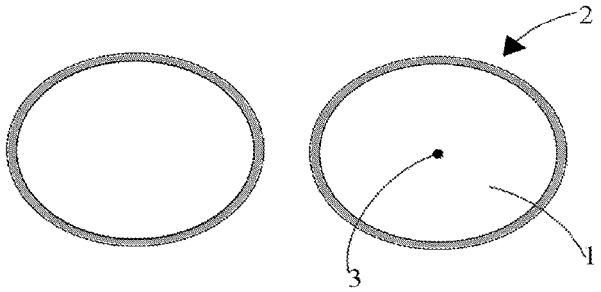
FIG. 1A is a top plan view of two flat base members.

The lighted display device disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

As taught herein, a shaped, lighted area may be defined as the largest possible space for the visualization of an open eye or eyes, and this space is then reduced by artistically designed segments that are selectively unlit or lit at lesser brightness than other segments to create negative space(s) within the view of the entire eye and thereby give the illusion that the shapes of the eyes have changed. Emotive expression is thus mimicked. The ability to program minutely gradual illumination transitions between selected illumination devices or light sources offers a fluid and natural animation effect between open and emotive states. The illumination devices or light sources can comprise light emitting diodes (LEDs), and reference may be made to LEDs hereafter with the understanding that other illumination devices or light sources that might now exist or hereafter be developed might alternatively be employed. Such a basic process gives rise to many different embodiments but is probably best understood in the preferred embodiment following, which exemplifies certain principles of the invention and conforms to the cost restrictions necessary for today's character toy product.

In (FIG. 1A, 2) represents the eye cavities in the molded base members or molds required to animate a character's eyes. The cavities have an illumination volume indicated at 1 that is illuminated by an LED at 3. These molds 2 can be placed under a translucent fabric, plastic or paper graphic representation panel 32 of the eyes, as shown in FIG. 1B and such placement must be in exact registration with the eye graphic. Furthermore, a translucent covering 34 can be disposed over the primary cavity underneath the panel 32. When the LEDs at 3 are illuminated, there is an increased brightness change to the eye graphic on the fabric or paper, giving the illusion that the eye is open, as seen in FIG. 1B, where the eye graphic of sclera, iris, pupil and white highlight is marked as 4. When the LEDs 3 are turned off, the difference between added light and no added light makes the eye appear closed, or blinked. A speaker 38 can be retained relative to the character for emitting sounds, and the sounds emitted by the speaker 38 can be synchronized with the pattern of illumination of the plurality of illumination devices 3 so the eye shapes show in concert with the emotive content of the sounds. The plurality of illumination devices 3 can be programmed to illuminate in a pattern, including by use of a microprocessor 42, a printed circuit board (PCB) 44, an integrated circuit (IC) 46, electronic wires 48, and a switch 50, all schematically illustrated in FIG. 1B with the details of the same being readily understood by one skilled in the art after reading the present disclosure.

The present invention calls for specific programming for all LEDs 3 placed within eye cavities to give one particular blink procedure, referred to as Blink 1. Further, it provides for a second blink procedure, referred to as Blink 2, where specific base member chamber shapes are combined with a second specific programming for two or more LEDs 3 within eye cavities. The LEDs 3 in the eye cavities are typically white, although other colors can be used for special effect.

Blink 1 is an ON-OFF action, but the display device can incorporate a fast fade-up added before the LEDs illuminating volume 1 reach the brightest ON point and a fast fade-down added before those LEDs reach the completely OFF point. It is known that our eyes retain the image of light momentarily when a light is abruptly turned off. The retained light image is often referred to as a "ghost image". The fade periods in this programming minimize the abrupt effect of ghost images and make the blinking or eye closing a more fluid process with a more natural look. The fading speed can be varied for differing animated effects. FIG. 1C shows the fade effect shadowing around the edges 5 of the eye graphic.

Figure 2A:
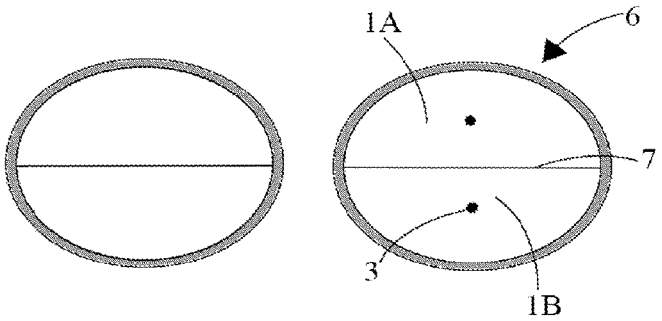
FIG. 2A is a top plan view of two flat base members divided into two separately illuminated chambers.
Figure 2B:
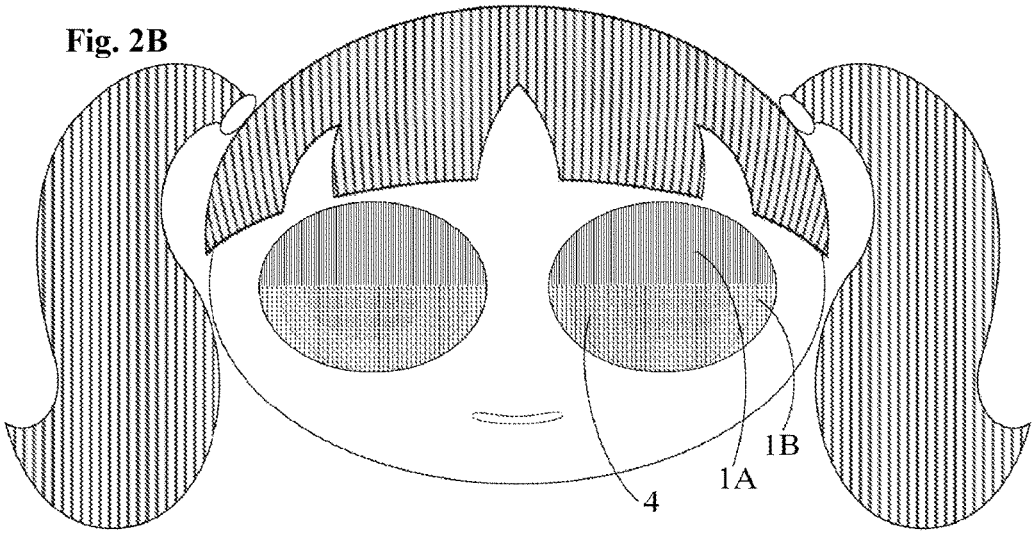
FIG. 2B is a view in front elevation of the lighted display device of FIG. 1B at the start of the animated condition of Blink 2.
Figure 2C:
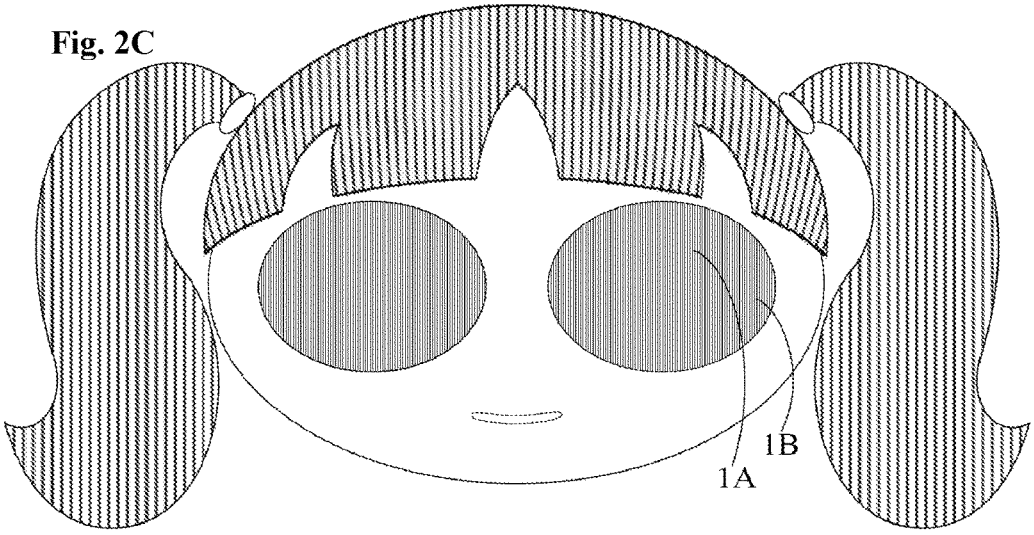
FIG. 2C is a view in front elevation of the lighted display device of FIG. 1B and FIG. 2B at the end of the animated condition for both Blink 1 and Blink 2, when all light sources are OFF.

Blink 2 is a more sophisticated program designed to mimic the effect of an eyelid closing from top to bottom. As shown in FIG. 2A, the eyes base member cavities 6 are divided in half by a thin wall 7 to create a split-chambered cavity where the illumination volume of the top chamber is indicated at 1A and the illumination volume of the bottom chamber is indicated at 1B. Each chamber has an open inner volume that can be bounded by a layer of reflective material 36 interposed between the open inner volume of each chamber and the primary cavity. The illuminating volume 1A begins a fade-down first. When it reaches about 75% brightness, the illuminating volume 1B begins a fade down at a slightly faster speed. The program is timed to have both LEDs 3 reach 40% brightness at the same time. At the moment of equal 40% brightness, the LED illuminating volume 1A turns off, as shown in FIG. 2B, and the LED illuminating volume 1B continues to fade down from 40% to 100% OFF as is also shown in FIG. 2B. The final closed eye in a blink cycle is achieved when the LEDs 3 illuminating volume 1A and 1B are both at 100% OFF mode, as indicated in FIG. 2C. Transitioning from a top fade to a bottom fade when the LEDs 3 illuminating volumes at 1A and 1B are at equal brightness both covers the minor light disruption made by the thin wall 7 in the base member and also gives the illusion that the eye is closing from top to bottom. The timing of this fade down can be varied to create different expressive effects, and it can be used in reverse for a particular eye-opening effect.

Figure 3:
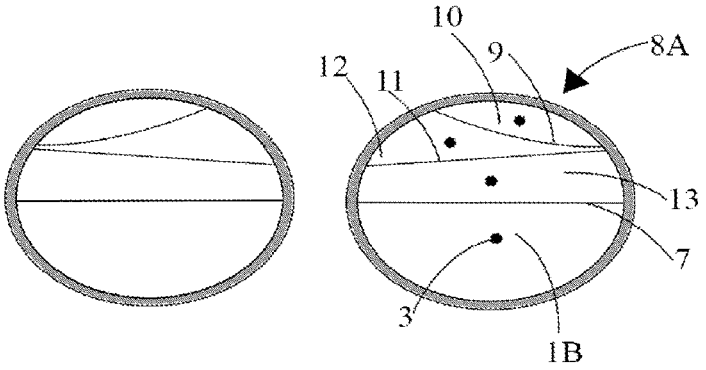
FIG. 3 is a top plan view of two flat base members divided into four separately illuminated chambers capable of producing at least eight expressions.

Blink 2, described above, adds an element of realism to the character's eye functions. In a similar fashion, expressions of happiness, sadness, anger, and intensity can be expressed by creating negative space to alter the illuminated area of the eye to conform to shapes of typical human eye expressions of those and other emotions. As shown in FIG. 3, the eyes base member cavities indicated at 8A are divided into multiple chambers in the top half of the base member by multiple thin walls. The thin wall indicated at 9 creates an illumination volume at 10; the thin wall indicated at 11 creates an illumination volume at 12; and the thin wall indicated at 7 is retained to keep the lower illumination volume at 1B while creating a new illumination volume in the upper half of the base member at 13.

The base member 8A shown in FIG. 3 has the structure for producing shapes necessary to mimic typical human eye shapes for the distinct emotions discussed:

Open eyes/at rest; Blink 1 and Blink 2; Winking;

and for the at least three unique emotive expressions discussed:

Sad/concern;

Anger/unhappiness/disgust; and

Intensity/concentration/suspicion.

Other configurations of thin walls within eye cavities base members can be constructed to express other emotions as desired, the only limitation being the size of the eye cavities.

Figure 4A:
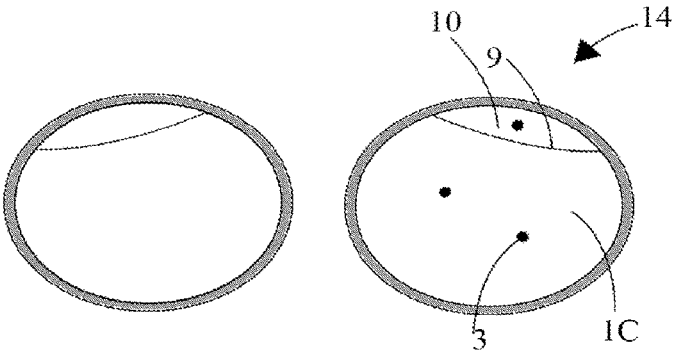
FIG. 4A is a top plan view of two flat base members divided into two separately illuminated chambers depicting a sad/concerned expression.

In FIG. 4A, the eyes base member cavities 14 are configured with thin walls to create an expression of sadness or concern. Using this base member 14 will allow only two expressions for the character:

1. Open eyes/at rest—shown when the LEDs illuminating the volumes 10 and 1C are uniformly lit; and
2. Sad/concern—shown when the LED illuminating the volume at 10 is OFF or at a lesser brightness than the LED illuminating the volume at 1C to create a negative space within the view of the entire eye and define a new perceived eye shape that is consistent with eyes showing a sad/concerned expression.

For this chamber of the eye cavity, the illumination volume at 10 and for all chambers designed into the eye cavity, it is possible to employ a variety of animating techniques for the LED(s) illuminating the volumes of those chambers, including: an intermittent on/off program, a fade up/fade down program, a PWM (pulse width modulation) program, by way of example and not limitation. It is also possible to coordinate animating techniques between the LEDs illuminating the different chambers in the eye cavities to produce special effects. Grouping and ungrouping the LEDs to control them singly or in concert offers differing, special animated effects.

Figure 4B:
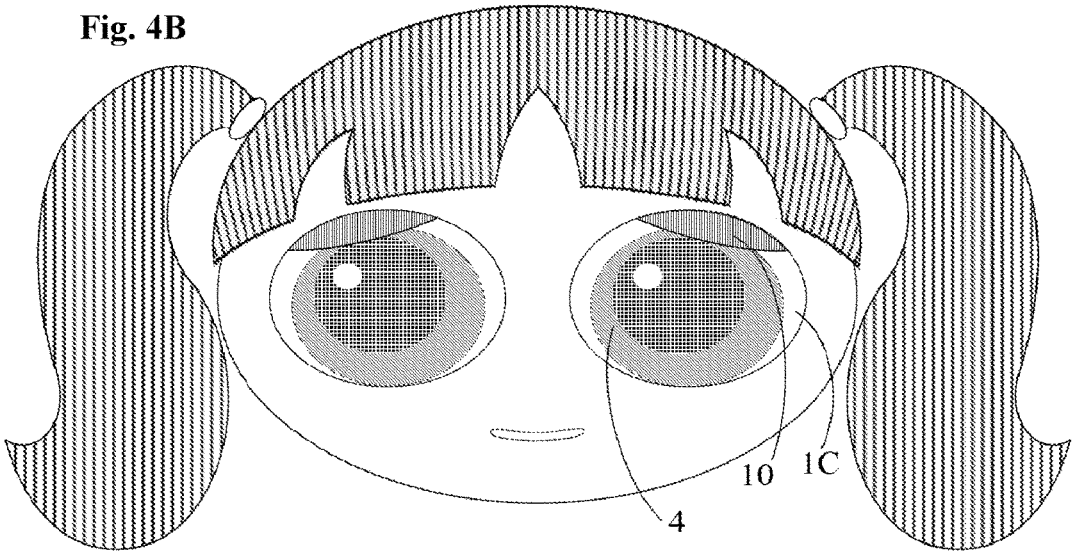
FIG. 4B is a view in front elevation of the lighted display device of FIG. 4A in the form of a doll in the sad/concerned animated condition.

FIG. 4B shows the result of the base members 14 of FIG. 4A placed behind a facial graphic and illuminating the volumes at 10 and 1C in that base member as previously described. Base members 14 is the simplest mold capable of achieving the sad/concerned expression; this expression can also be realized using the base members 8A of FIG. 3. In this case, the LEDs illuminating the volumes at 12, 13, 1B may be treated as the same LED and controlled in concert. This leaves different possibilities for each Blink procedure: Blink 1 can involve only the LEDs illuminating volumes at 12, 13, 1B, or it can involve all the LEDs in the cavity taking the start of the fade at a different level for each of the two groups, such as the LEDs at 12, 13, 1B and the LED at 10. Blink 2 can be achieved by grouping the LEDs into two different groups, one with the LEDs illuminating volumes at 10, 12, 13 where the start of the fade at volume 10 will be at a different level that those at 12, 13 and the other group being the LED illuminating the volume at 1B. Since the illumination volumes at 12, 13 and 1B together equal the illumination volume 1C shown in FIG. 4A, some decision as to each base member's advantage must be made. The base member 14 at FIG. 4A is a simpler construct. However, using the base member 8A at FIG. 3 also allows for the possibility of activating three additional expressions. The decision on whether to use the simpler or more complex base member will have to be made on a case-by-case basis.

Figure 5A:
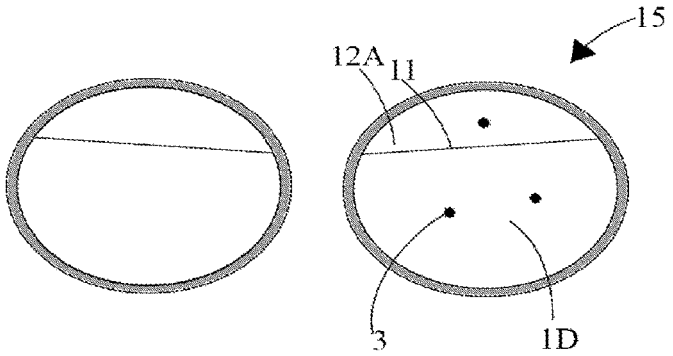
FIG. 5A is a top plan view of two flat base members divided into two separately illuminated chambers depicting an angry or disgusted expression.

In FIG. 5A, the eyes base members cavities 15 are configured with thin walls to create an expression of anger, unhappiness or disgust. Using this mold will allow only two expressions for the character:

1. Open eyes/at rest: shown when the LEDs illuminating the volumes at 12A and 1D are uniformly lit.
2. Anger/unhappiness/disgust: shown when the LED illuminating the volume at 12A is OFF or at a lesser brightness than the LED illuminating the volume at 1D to create a negative space within the view of the entire eye and define a new perceived eye shape that is consistent with eyes showing an angry/unhappy/disgusted expression. The anger/unhappiness/disgust expression can be modified using various animating techniques for the LED illuminating the volume at 12A, as described above. It's also possible to apply some animating techniques to the LED illuminating the volume at 1D as well, and further, to coordinate animating techniques between the LEDs illuminating the two volumes.

Figure 5B:
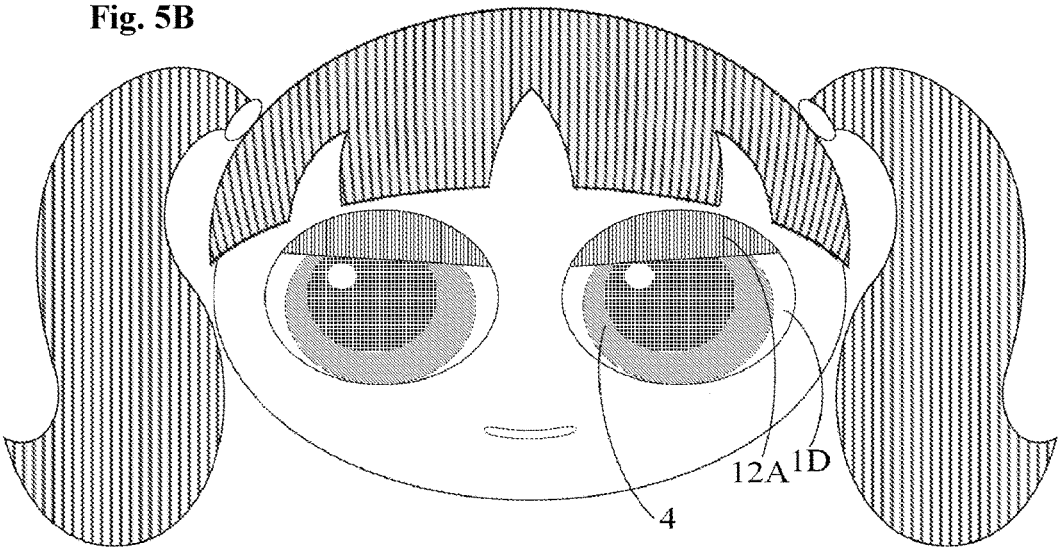
FIG. 5B is a view in front elevation of the lighted display device of FIG. 5A in the form of a doll in the angry or disgusted animated condition.

FIG. 5B shows the result of the mold set 15 of FIG. 5A placed behind a facial graphic and LEDs illuminating the volumes at 12A and 1D in those molds as previously described to achieve the angry/unhappy/disgusted expression. Again, although FIG. 5A, the mold set 15 is the simplest mold available to achieve this expression, that expression can also be realized using the molds 8A of FIG.

3. For this case, the LEDs illuminating the volumes at 12 and 10 would be treated as the same LED and controlled in concert. In addition, the LEDs illuminating the volumes at 13 and 1B would be treated as the same LED and controlled in concert until the time that a Blink 2 cycle begins. Blink 1 can involve only the LED illuminating the volume at 1D, or it can involve all the LEDs in the cavity taking the start of the fade at a different level for each of the two groups of LEDs: one group illuminating the volumes at 12, 10 and the other illuminating the volumes at 13, 1B. Blink 2 can be achieved by grouping the LEDs differently: one group illuminating the volumes 10, 12, 13 where the start of the fade at volumes 10, 12 will be at a different level that that at 13 and the other group being the LED illuminating the volume at 1B. Since the illumination volumes at 12 and 10 together equal the illumination volume 12A shown in FIG. 5 again, some decision as to each mold's different advantages must be made.

Figure 6A:
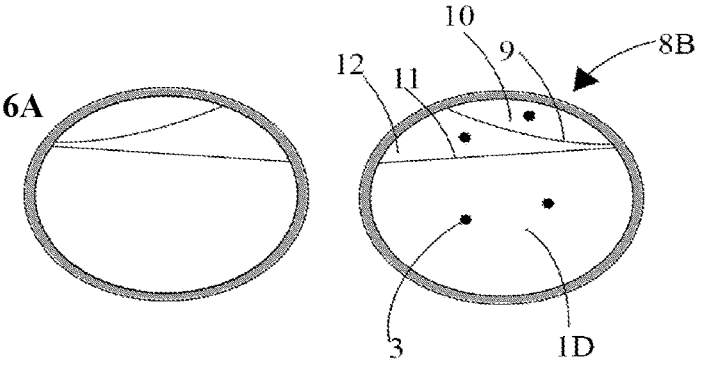
FIG. 6A is a top plan view of two flat base members divided into three separately illuminated chambers to depict both the sad/concerned and angry/disgusted expressions.

In FIG. 6A, the eye molds cavities 8B are configured with thin walls to create three expressions for the character:

1. Open eyes/at rest: shown when the LEDs illuminating the volumes at 10, 12 and 1D are uniformly lit.
2. Sad/concern: shown when the LEDs illuminating the volumes at 12 and 1D are treated as one LED and controlled in concert. Then, the LED illuminating the volume at 10 is at a lesser brightness than the LEDs illuminating the volumes at 12 and 1C to create a negative space within the view of the entire eye and define a new perceived eye shape that is consistent with eyes showing a sad/concerned expression. The sad/concerned expression can be modified using various animating techniques for the LED illuminating the volume at 10, as previously described.
3. Anger/unhappiness/disgust: shown when the LED illuminating the volume at 12 and the LED illuminating the volume at 10 are treated as one LED and controlled in concert, at a lesser brightness than the LED illuminating the volume at 1D to create a negative space within the view of the entire eye and define a new perceived eye shape that is consistent with eyes showing an anger/unhappiness/disgust expression.

Figure 6B:
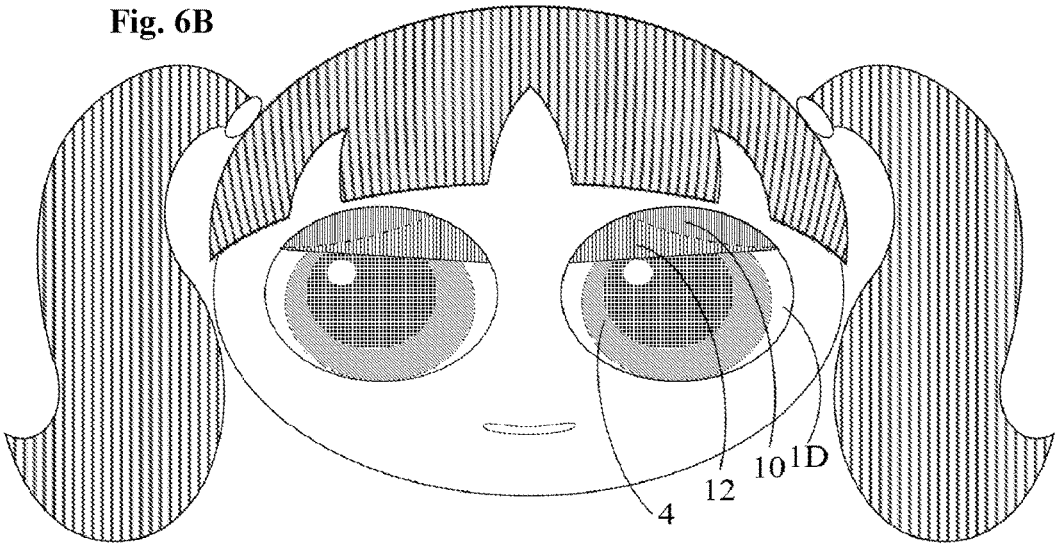
FIG. 6B is a view in front elevation of the lighted display device of FIG. 6A in the form of a doll in the angry or disgusted animated condition.

FIG. 6B shows the result of the mold 8B in FIG. 6A placed behind a facial graphic and illuminating the volumes of the chambers in that mold to express the anger/unhappiness/disgust expression as previously described.

All simple molds, to wit: 6 in FIG. 2A, 14 in FIG. 4A, 15 in FIG. 5A, and in FIGS. 6A, 8B) and (7A, 8C) exist within the complex mold 8A of FIG. 3 and as stated in the discussion of the mold 14 of FIG. 4A: choice of using simple or complex molds will be made on a case-by-case basis by determining the relative advantages of each.

Figure 7A:
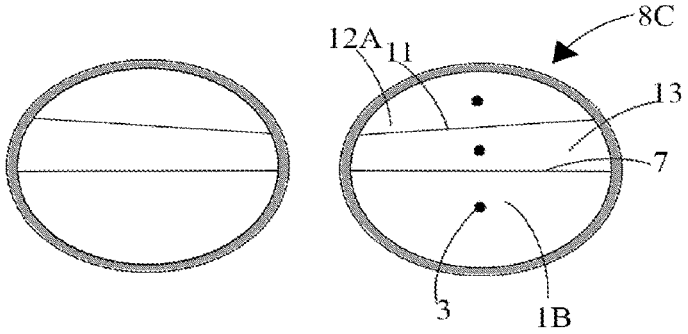
FIG. 7A is top plan view of two flat base members divided into three separately illuminated chambers to depict both the angry/disgusted and intense/concentrating/suspicious expressions.
Figure 7B:
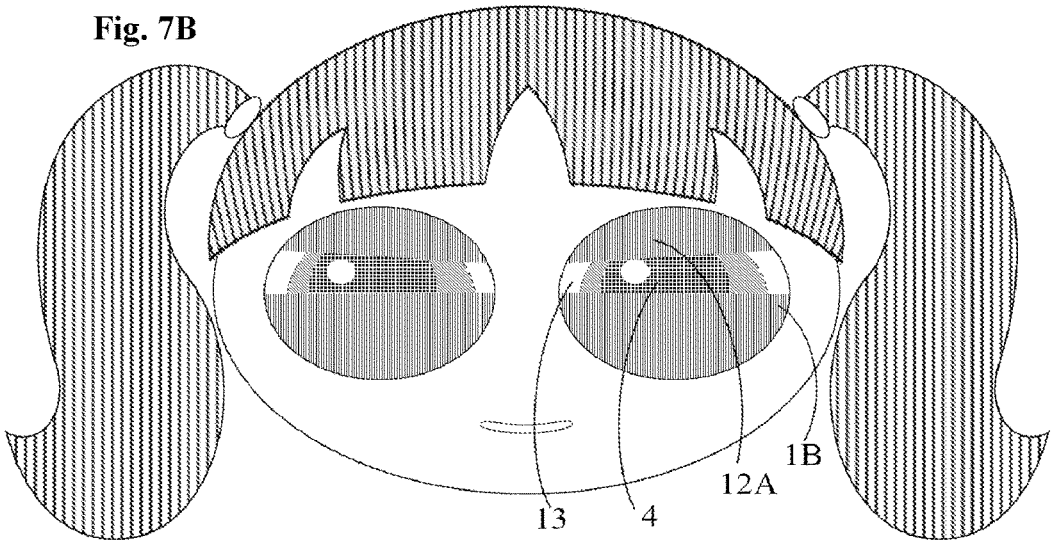
FIG. 7B is a view in front elevation of the lighted display device of FIG. 7A in the form of a doll in the intense/concentrating/suspicious animated condition.

A simplified version of the final expression afforded by the molds 8A of FIG. 3 is shown at 8C in FIG. 7A. This expression is one of intensity, concentration or suspicion. To achieve this expression in the simplified molds, the LEDs illuminating the volumes 12A and 1B are initially treated as one LED and controlled in concert as OFF or at a lesser brightness than the LED illuminating the volume at 13 to create a negative space within the view of the entire eye and define a new perceived eye shape that is consistent with eyes showing an intense, concentrating or suspicious expression. The animated programming for this expression can allow for a subsequent disparity in brightness at volume 12A and 1B. As before, animating techniques are available to the LEDs illuminating all the chambers of this eye cavity configuration.

This same expression can be achieved using the molds 8A of FIG. 3, where the LEDs illuminating the volumes at 10, 12 and 1B are treated as one LED and controlled in concert as OFF or at a lesser brightness than the LED illuminating the volume at 13 to create the necessary negative space.

All the eye cavities shown previously have had regular rounded shapes. It's also possible to create fanciful eye shapes for people, animals, monsters and other fantasy characters. Such eye shapes can also be paired with other fanciful facial details, such as mouths, beauty marks and the like, in order to strengthen the fanciful identification of the character.

Figure 8A:
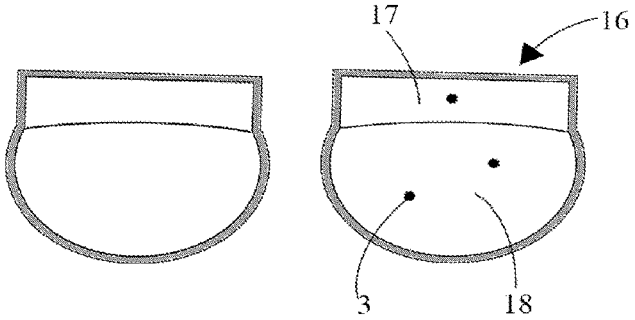
FIG. 8A is a top plan view of two flat base members divided into two separately illuminated chambers to depict a fanciful eye expression.

In FIG. 8A, the eyes mold cavities 16 are configured in two parts to create an unusual appearance for a cartoon character. The LEDs illuminating the volume at 17 are meant to have color or mixed color, and the LEDs illuminating the volume at 18 can be either white or colored, depending on the look of the cartoon character.

Figure 8B:
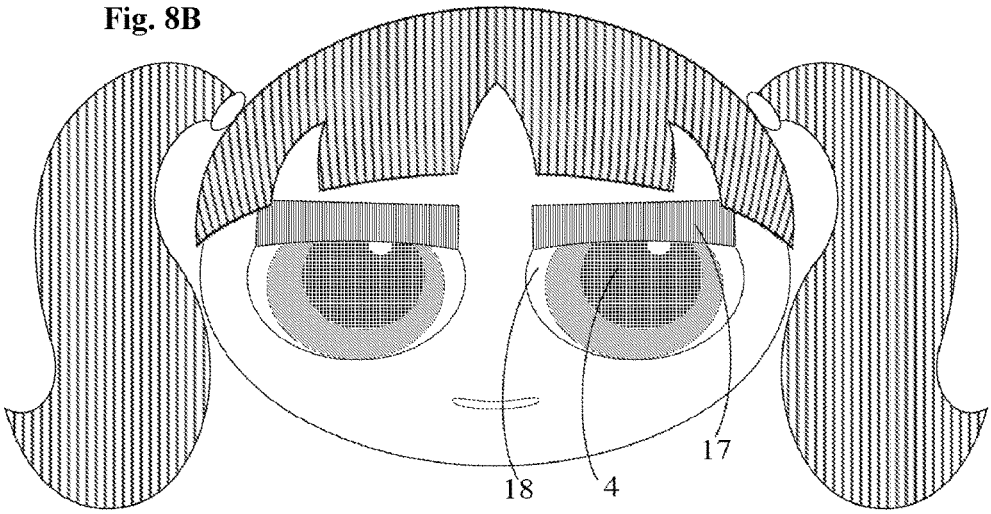
FIG. 8B is a view in front elevation of the lighted display device of FIG. 8A in the form of a doll with a fanciful animated condition.

FIG. 8B shows the result of the mold 16 of FIG. 8A placed behind the facial graphic of a girl. The unusual shape of the eye cavities renders the girl's facial expression unique. The expressions available by use of this mold are limited: a Blink 1 for the illumination volume at 18 and/or 17; possibly a Blink 2 between the two illumination volumes at 18 and 17; reciprocal illumination between the illumination volumes of the two chambers; flashing; long periods of on/off, etc. The result here will not be a mimicry of traditional human expression, but rather a fanciful exaggeration of expressions as one would expect from a cartoon character.

With certain details of the present invention for animating eye expressions in a lighted display device disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Figure 9:
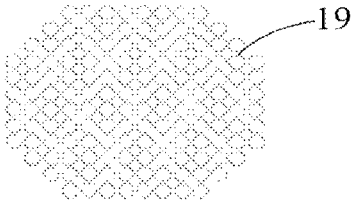
FIG. 9 is a view in front elevation of an LED matrix.

For example, the negative spaces in the molds just described can also be achieved by selectively illuminating the LEDs in an LED matrix 19, as shown in FIG. 9. Blink 1 and Blink 2 programming for all matrix conditions shown in FIGS. 10, 11, and 12 is achieved by using previously described programming for Blink 1 on all currently illuminated LEDs and for Blink 2 by using all previously described programming for that Blink and substituting a row-by-row, top-to-bottom activation of all currently activated LEDs in place of the sectional activation shown and described in relation to FIGS. 1C, 2B, and 2C. The minutely programmed illumination transitions used in the sectional animation approach previously described are also available in this embodiment. However, when programming the LEDs in all the matrixes shown, the line between illuminated LEDs and OFF or less bright LEDs will not be distinct, as it is in the sectional animation in the first embodiment just described. Radiance from the ON LEDs will soften the demarcation of the sections 21, 22, 23 and 24 shown in all matrix conditions of FIGS. 10, 11, and 12.

The matrixes shown in FIGS. 10 are a single color and are exposed behind a protective clear resin layer and function as an eye feature without any printed overlay. In FIG. 10A, the matrix is the equivalent of the "all-on" state of the previous molds 2 in FIG. 1A, signifying open and at rest emotion. The sad/concerned expression of the mold 14 shown in FIG. 4A is replicated in the matrix 20B of FIG. 10B where the OFF or less bright than other LEDs form the group at 21 as an equivalent to the negative space in the OFF or less bright than others area 10 previously shown in FIG. 4A. The angry/unhappy/disgusted expression of the mold 15 of FIG. 5A is replicated in the matrix 20C of FIG. 10C where the OFF or less bright than other LEDs form the group at 22 as an equivalent to the negative space in the OFF or less bright than others area previously shown in FIG. 5, 12A. The intense/concentrating/suspicious expression shown at 8C in FIG. 7A is replicated in the matrix 20D of FIG. 10D, where the OFF or less bright than other LEDs form two groups: the top group at 23 and the bottom group at 24, these two groups being equivalents to the negative spaces in the OFF or less bright than other areas previously shown at FIG. 7A, 12A and 1B, respectively.

Figure 11A:
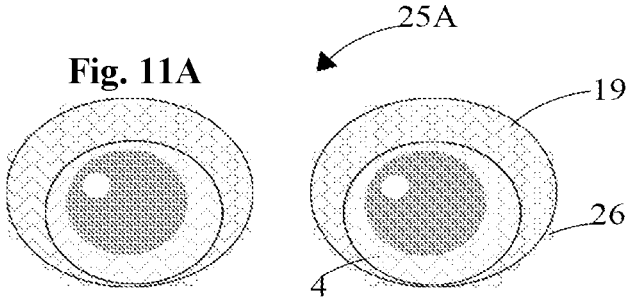
FIG. 11A is a view in front elevation of the LED matrix in FIG. 10A placed behind a fabric or plastic eye graphic with all light sources ON, to be used in a character's face.

It is also possible to place the matrix behind a translucent fabric, plastic or paper graphic representation of the eyes in the way previously described for the mold that has negative spaces. In this case, FIG. 11A shows all LEDs on in matrix 25A, as indicated at 2 in FIG. 1A. The graphic overlay shows the sclera, iris, pupil and white highlight at 4, and the result of this configuration of matrix 25A is an open-eyed, at rest expression. Unless the matrix is custom-fit to the printed eye graphic, there will be some LED matrix portions 26 that protrude from around the edge of the printed eye and in other similar spots around the perimeter of the eye graphic. This will require a mask to be placed around the perimeter of the eye outline on the underside of the eye graphic, so light does not bleed around the edges of the eyes and ruin the realistic look of the eye.

Figure 11B:
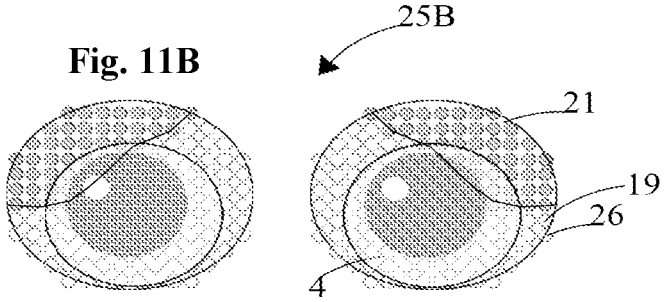
FIG. 11B is a view in front elevation of the LED matrix in FIG. 10B placed behind a fabric or plastic eye graphic with one section of light sources OFF or at a lesser brightness than other sections, to create a negative space within the view of the entire eye and to be used in a character's face to animate a sad/concerned expression.

The sad/concerned expression of the mold 14 shown in FIG. 4A is replicated in the matrix 25B of FIG. 11B where the OFF or less bright than other LEDs form the group at 21 as an equivalent to the negative spaces in the OFF or less bright than others area 10 previously shown in FIG. 4A. The angry/unhappy/disgusted expression of the mold 15 shown in FIG. 5A is replicated in the matrix 25C of FIG. 11C where the OFF or less bright than other LEDs form the group at 23 as an equivalent to the negative spaces in the OFF or less bright than others area 12A previously shown at FIG. 5A. The intense/concentrating/suspicious expression of the mold 8C shown in FIG. 7A is replicated in the matrix 25D of FIG. 11D, where the OFF or less bright than other LEDs form two groups: the top group at 23 and the bottom group at 24 as equivalents to the negative spaces in the OFF or less bright than others areas previously shown at FIG. 7A, 12A and 1B.

A particular animation opportunity is present in an LED matrix made up of RGB LEDs, and that is the ability to combine this uncovered matrix (FIG. 12, 30A-D) with the outer outline of an eye and then program the iris 29 as in FIG. 12, in any desirable color. This configuration also allows the programming to move the iris 29 about in the matrix, as shown when the overall matrix 30C looks to its left in FIG. 12C, or when the overall matrix 30D looks to its right as in FIG. 12D. In FIG. 12A, the overall matrix 30A simulates the "all-on" open-eyed, at rest expression, the iris 29 has been programmed in the center of the eye frame. The remainder of the LEDs here shows white, although they can be variously programmed and show colors to gain special effects. Additionally, in this matrix configuration, there is the opportunity to add a tiny white LED to the matrix at 27 and 28 to represent the highlight seen reflected in the eye. This small highlight feature adds great detail to the overall look of the eye when it sparkles from within the iris configuration. Another unique opportunity for this matrix is to change the color of the OFF or less bright than other LEDs shown in sections 21, 22, 23 and 24.

In this matrix configuration, both the iris color and the highlight illumination are secondary to the negative space effect provided by sections 21, 22, 23 and 24. For example, in the matrix 30B in FIG. 12B, the group of OFF or less bright than other LEDs at 21 overlaps the iris shape, so the iris LEDs 29 in that overlapping section must be turned OFF (or less bright than other sections) to complete the negative space 21 and thereby achieve the sad/concerned expression. Similarly, when the group of OFF or less bright than other LEDs overlaps the highlight at 27 and/or 28, those highlights must be turned off as well. For example, in the matrix 30B in FIG. 12B, the right eye has highlight 27 turned off while the left eye has highlight 27 on. Both eyes in FIG. 12B have highlight 28 on, as the negative space 21 does not affect the areas around those highlights.

Figure 1B:
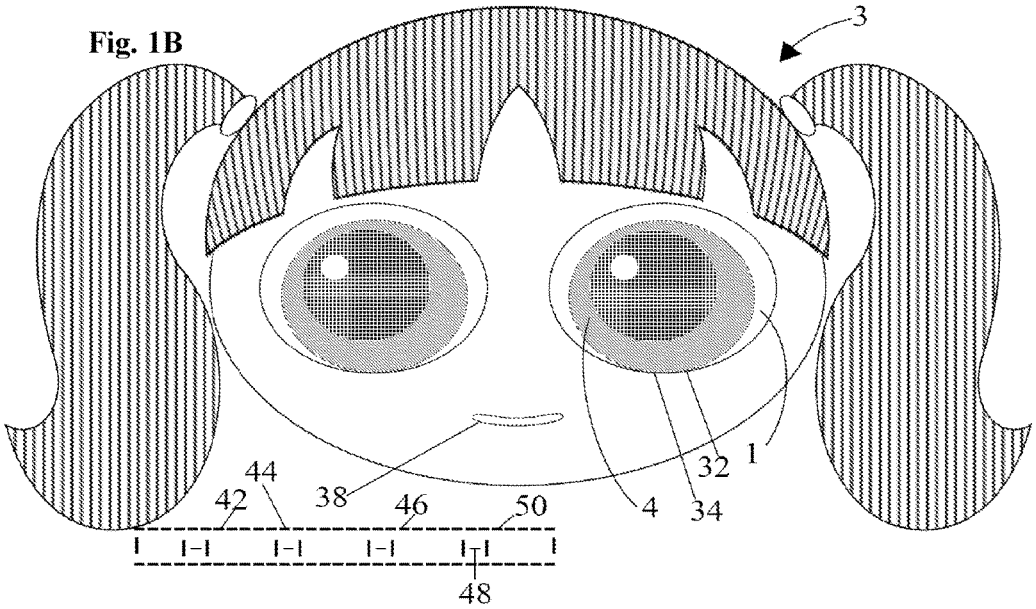
Figure 1C:
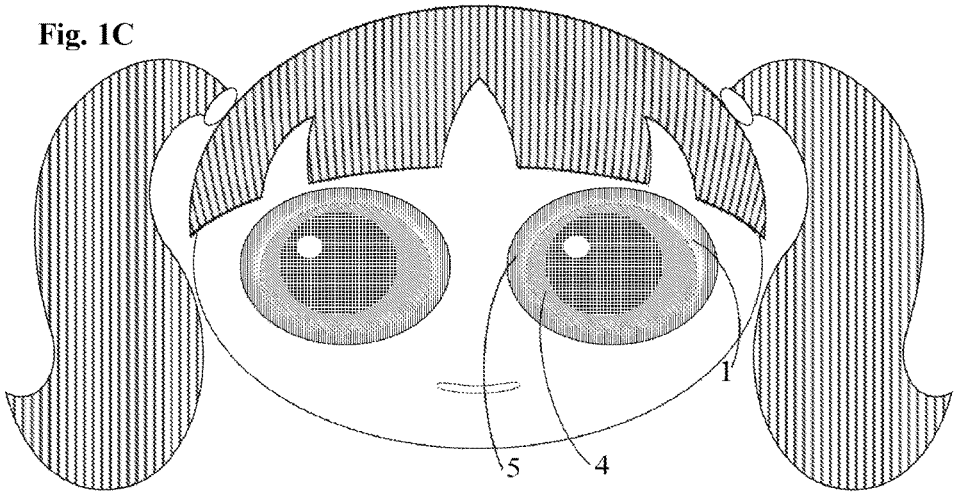
FIG. 1C is a view in front elevation of the lighted display device of FIG. 1B at the start of the animated condition of Blink 1, before all light sources turn OFF.
Figure 10A:
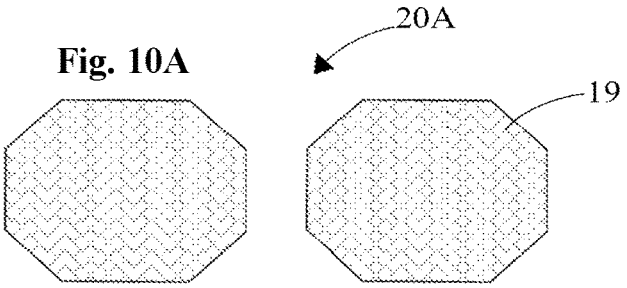
FIG. 10A is a view in front elevation of an LED matrix of single-colored light sources, formed into eye shapes with all light sources ON, to be used in a character's face
Figure 10B:
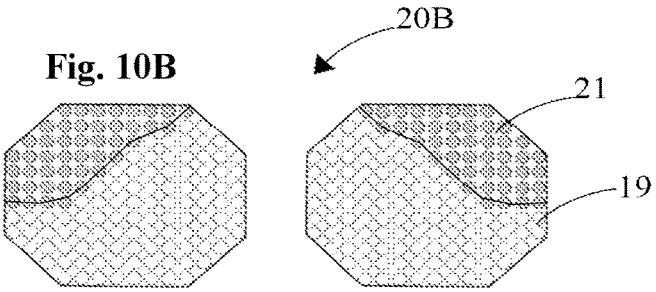
FIG. 10B is a view in front elevation of the LED matrix in FIG. 10A formed into eye shapes with one section of light sources OFF or at lesser brightness than other sections, to create a negative space within the view of the entire eye and to be used in a character's face to animate a sad or concerned expression.
Figure 10C:
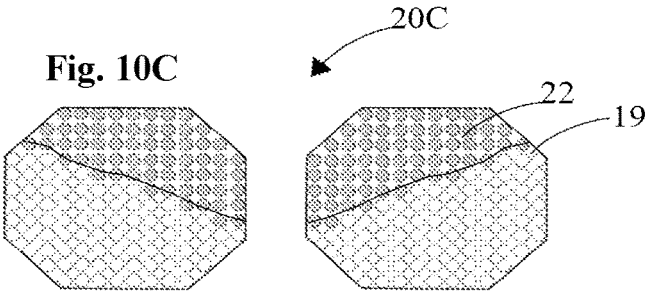
FIG. 10C is a view in front elevation of the LED matrix of FIG. 10A formed into eye shapes with one different section of light sources OFF or at lesser brightness than other sections, to create a negative space within the view of the entire eye and to be used in a character's face to animate an angry or disgusted expression.
Figure 10D:
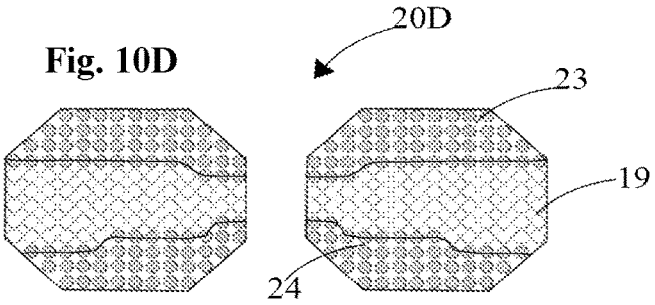
FIG. 10D is a view in front elevation of the LED matrix in FIG. 10A formed into eye shapes with two sections of light sources OFF or at a lesser brightness than other sections, to be used in a character's face to create a negative space within the view of the entire eye and to animate an intense, concentrating or suspicious expression.
Figure 11C:
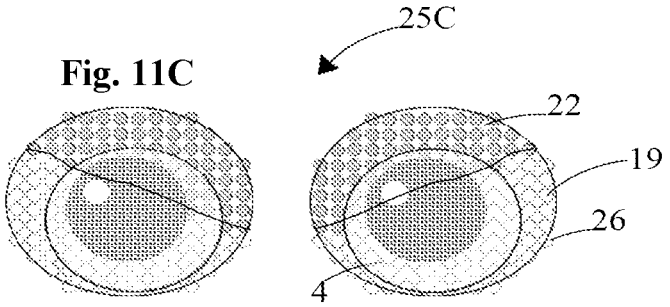
FIG. 11C is a view in front elevation of the LED matrix in FIG. 10C placed behind a fabric or plastic eye graphic with one different section of light sources OFF or at a lesser brightness than other sections, to create a negative space within the view of the entire eye and to be used in a character's face to animate an angry or disgusted expression.
Figure 11D:
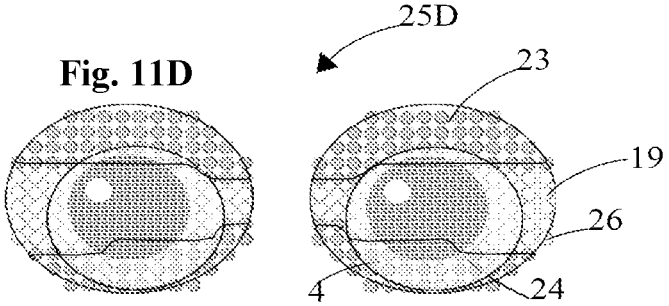
FIG. 11D is a view in front elevation of the LED matrix in FIG. 10D placed behind a fabric or plastic eye graphic with two sections of light sources OFF or at a lesser brightness than other sections, to create a negative space within the view of the entire eye and to be used in a character's face to animate an intense or concentrating expression.
Figure 12A:
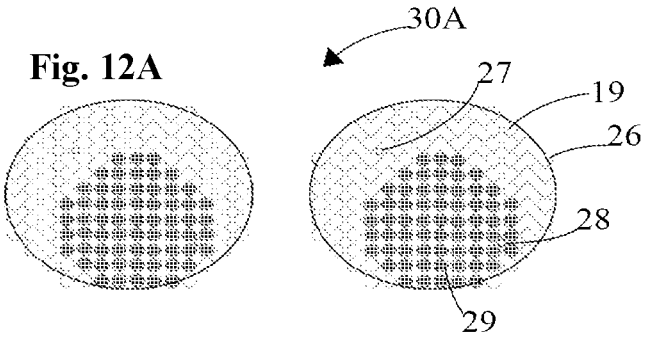
FIG. 12A is a view in front elevation of an LED matrix of RGB-LEDs formed into eye shapes, with two added smaller white light sources and with an iris programmed to have contrasting color with all light sources ON, to be used in a character's face.
Figure 12B:
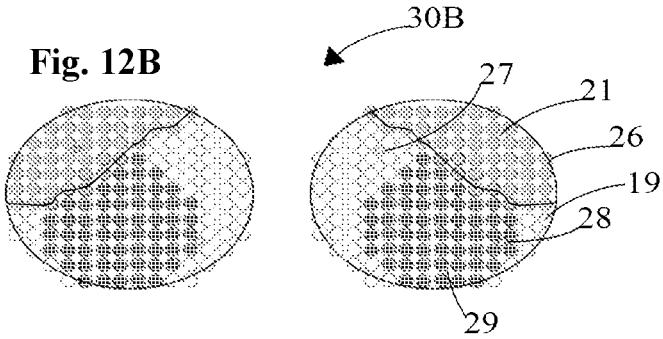
FIG. 12B is a view in front elevation of the LED matrix in FIG. 12A with one section of light sources OFF or at a lesser brightness or different color than other sections, to create a negative space within the view of the entire eye and to be used in a character's face to animate a sad or concerned expression.
Figure 12C:
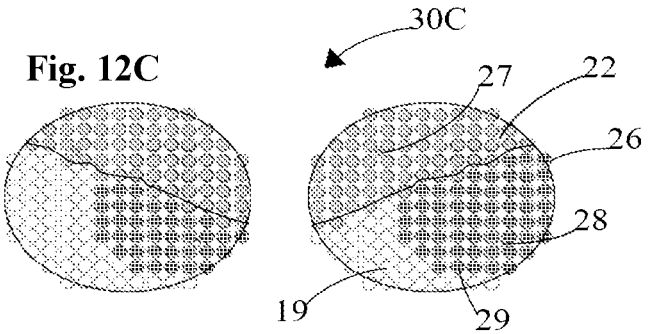
FIG. 12C is a view in front elevation of the LED matrix of FIG. 12A with the iris moved to a side-eye position and one different section of light sources OFF or at a lesser brightness or different color than other sections, to create a negative space within the view of the entire eye and to be used in a character's face to animate an angry or disgusted expression.
Figure 12D:
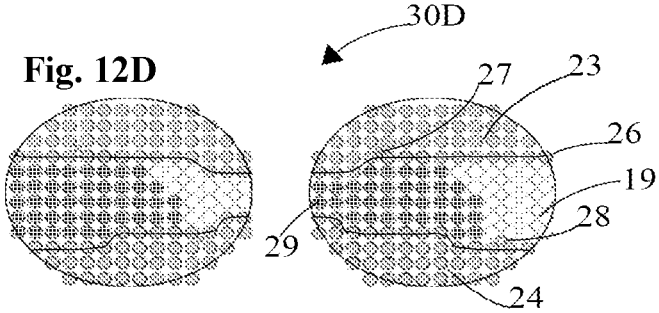
FIG. 12D is a view in front elevation of the LED matrix in FIG. 12A with the iris moved to an alternate side-eye position, with two sections of light sources OFF or at a lesser brightness or different color than other sections, to create negative spaces within the view of the entire eye and to be used in a character's face to animate an intense or concentrating expression.

Apart from the specific iris, highlight and color refinements previously discussed, the emotive effects of the matrix at:

1) Matrix 30A in FIG. 12A are equivalent to those at 20A in FIG. 10A, 25A in FIG. 11A, and 2 in FIG. 1A;
2) Matrix 30B in FIG. 12B are equivalent to those at 20B in FIG. 10B, 25B in FIG. 11B, and 14 in FIG. 4A;
3) Matrix 30C in FIG. 12C are equivalent to those at 20C in FIG. 10C, 25C in FIG. 11C, 15 in FIG. 5A, and 8B in FIG. 6A; and
4) Matrix 30D in FIG. 12D are equivalent to those at 20D in FIG. 10D, 25D in FIG. 11D, and 8C in FIG. 7A.

The conclusion reached after discussion of the analogous first (single cavity) embodiment is aptly repeated here as conclusion for the second (LED matrix) embodiment: With certain details and embodiments of the present invention for a lighted display device disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. These claims shall be construed to cover not only the corresponding structure and material expressly described in this specification but also all equivalents thereof that might be now known or hereafter discovered.

I claim as deserving the protection of Letters Patent:

1. An illuminated display device simulative of an eye or eyes that can be fitted to a non-virtual character, comprising:

an LED matrix with an outer dimension representing the largest area possible for visualizing the eye or eyes;

a processor disposed in optical communication with individual LEDs in the LED matrix enabling the individual LEDs to be individually illuminated within a programmed display;

wherein the processor creates uniquely shaped sections within the LED matrix and illuminates LEDs in each of the uniquely shaped sections;

wherein the processor may also select additional LED or LEDs from within the LED matrix for illumination alongside the illumination of the uniquely shaped sections;

wherein each of the uniquely shaped sections combined with the additional LEDs when those are used, represents a view of a distinct emotive response and wherein reconfigurable combinations of the uniquely shaped sections combined with the additional LEDs when those are used, can yield possible views of eight or more of the distinct emotive responses, which responses can include a varied speed in a fast fade with on/off illumination as blinking for differing animating effects and varied fade-down timing in a specifically programmed row-by-row illumination as blinking for different expressive effects;

wherein the processor causes the uniquely shaped sections combined with the additional LEDs when those are used, to illuminate in a pattern;

wherein one or more of the illuminated display devices is used to simulate the eye or eyes fitted to the non-virtual character and the uniquely shaped sections within the LED matrix of the display device are, in their aggregate, capable of showing a whole shape of the eye or eyes and wherein the individual LEDs of the LED matrix can be turned OFF or illuminated at lesser brightness and/or different color than other LEDs in the LED matrix to thereby establish negative space(s) within the whole shape of the eye or eyes such that the negative space(s) detract from an overall illuminated shape of the eye or eyes simulative of a perceived change in shape of the eye or eyes shown when demonstrating one of the eight or more distinct emotive responses.

2. The illuminated display device of claim 1 wherein the individual LEDs in the LED matrix may be the same color.

3. The illuminated display device of claim 1 wherein the individual LEDs in the LED matrix may be multi-colored, including RGB.

4. The illuminated display device of claim 1 further comprising a speaker retained relative to the character for emitting sounds having variable emotive content, the processor for synchronizing the variable emotive content of sounds emitted by the speaker with the illuminative pattern of the uniquely shaped section(s) combined with the additional LEDs when those are used, in the LED matrix such that the emotive content of sounds sequentially pairs with a sequential view of some or all of the eight or more distinct illuminative emotive responses.

5. The illuminated display device of claim 4 comprising the eye or eyes for the character that change perceived size in synch with the emotive content of sounds to create an illusion that the eye or eyes are changing shape and sequentially demonstrating some or all of the eight or more distinct emotive responses.

6. A pair of the illuminated display devices of claim 1 where the processor causes the uniquely shaped section(s) combined with the additional LEDs when those are used, of the pair of illuminated display devices to illuminate in a pattern that can be selectively synchronized or operative to illuminate the uniquely shaped section(s) combined with the additional LEDs when those are used, in an independent pattern for viewing some or all of the eight or more distinct illuminative emotive responses.

7. The pair of illuminated display devices of claim 6 wherein the display devices comprise the eye or eyes for the character that change perceived size in synch with emotive content of sounds to create an illusion that the eye or eyes are changing shape and sequentially demonstrating some or all of the eight or more distinct emotive responses.

8. The illuminated display device of claim 3 further comprising electronic memory and programming to establish one of the uniquely shaped sections simulative of an eye iris within the LED matrix that illuminates at a contrasting brightness and/or color to all remaining LEDs of the LED matrix and wherein the one of the uniquely shaped sections simulative of the eye iris can be visibly adjusted from a center to corners of the LED matrix and programmed to illuminate secondary to the negative space(s) of the eye or eyes so that programming for the negative space(s) is used in the part of the one of the uniquely shaped sections simulative of the eye iris crossed by a path of the negative space(s).

9. The illuminated display device of claim 8 wherein the LED matrix may include at least one LED of smaller size than remaining LEDs of the matrix, positioned in the matrix simulative of light reflecting in the eye or eyes.

10. The illuminated display device of claim 9 wherein the at least one LED of smaller size, when included, is programmed secondary to the programming for the negative space(s) so that the programming for the negative space(s) is used in programming for the at least one LED of smaller size whenever paths of the at least one LED of smaller size and the negative space(s) cross.

11. The illuminated display device of claim 1 further comprising a panel over the LED matrix.

12. The illuminated display device of claim 11 wherein the panel over the LED matrix is marked with an eye graphic in registration with the LED matrix.

* * * * *